US005463963A

United States Patent [19]

Bernard et al.

[11] Patent Number: 5,463,963

[45] Date of Patent: Nov. 7, 1995

[54] METHOD OF CENTERING STEERABLE AXLES OF A BOGIE

[75] Inventors: Roger Bernard, Essertenne; Jacques Bevand, Le Creusot, both of France

[73] Assignee: GEC Alsthom Transport SA, Paris, France

[21] Appl. No.: 277,586

[22] Filed: Jul. 20, 1994

[30] Foreign Application Priority Data

Jul. 30, 1993 [FR] France ..... 93 09423

[51] Int. Cl.[6] ..... B61F 5/00

[52] U.S. Cl. ..... 105/168

[58] Field of Search ..... 105/165, 167, 105/168, 169, 170

[56] References Cited

U.S. PATENT DOCUMENTS

| | | | |
|---|---|---|---|
| 4,289,075 | 9/1981 | Smith | 105/165 |
| 4,640,198 | 2/1987 | Haupl | 105/168 |
| 4,982,671 | 1/1991 | Chollet et al. | 105/168 |

FOREIGN PATENT DOCUMENTS

| | | | |
|---|---|---|---|
| 0318923A1 | 6/1989 | European Pat. Off. . | |
| 0374290 | 6/1990 | European Pat. Off. | 105/165 |
| 2244655 | 4/1975 | France . | |
| 2530567A1 | 1/1984 | France . | |
| 882562 | 5/1953 | Germany . | |
| 1119899 | 10/1984 | U.S.S.R. | 105/168 |
| WO88/02712 | 4/1988 | WIPO . | |

OTHER PUBLICATIONS

French Search Report FR 9309423 Apr. 1994.

*Primary Examiner*—Mark T. Le

*Attorney, Agent, or Firm*—Sughrue, Mion, Zinn, Macpeak & Seas

[57] ABSTRACT

The present invention relates to a method of centering steerable axles of a bogie, wherein, on going into a curve in the track, at least one of the axles is steered towards the center of the curve, and wherein each wheel is positioned transversely relative to the track so that each of the wheels is at the same distance from its rail.

4 Claims, 1 Drawing Sheet

METHOD OF CENTERING STEERABLE AXLES OF A BOGIE

The present invention relates to a method of centering steerable axles of a bogie.

BACKGROUND OF THE INVENTION

More particularly, the method of the invention for centering steerable axles of a bogie is applicable to a bogie having two steerable axles. For example, such a bogie comprises a frame connected to each axle via two axle boxes and via primary suspension means formed of deformable resilient blocks.

In such prior art bogies, the axles are steered by means of actuators controlled by track sensors. Under the action of the actuators, the resilient primary suspension means become deformed so as to enable the axle to take up a radial position in a curve in the track. The axles are usually steered by flexible suspension means. The axles are then kept stable along straight stretches of the track by means other than the flexible suspension means.

The advantage of steerable-axle bogies, in particular for subway and tramway networks, is that they reduce the adverse effects caused by having metal-on-metal contact, namely: squealing, wear on rails and on wheels, and vibrations transmitted through the ground to buildings.

OBJECTS AND SUMMARY OF THE INVENTION

An object of the invention is to provide a method of centering steerable axles of a bogie, the method being based on a new servo-control principle and enabling the noise level of the rolling stock to be reduced.

According to an essential feature of the invention, on going into a curve in the track, at least one of the axles is steered towards the center of the curve, and each wheel is positioned transversely relative to the track so that each of the wheels is at the same distance from its rail.

According to another feature of the invention, in a curve in the track, at least one of the axles is disposed radially to the curve, and is centered transversely relative to the two rails of the track.

According to another feature of the invention:

a magnetic axis of symmetry of the rail associated with at least one detector is detected so as to obtain a signal which is a function of the position of said detector and of the position of said magnetic axis;

said signals are summed so as to obtain, for each axle, a resulting signal which is a function of the offset between the axle and said magnetic axis, and at least one axle is pivoted in the direction which enables said resulting signal to be reduced.

According to another feature of the invention, a signal whose value does not lie in a predefined range of values is considered to be invalid, the resulting signal then being extrapolated on the basis of a preceding value and of the only remaining valid signal.

According to another feature of the invention, if only one valid signal exists, then that signal is also invalidated, the last resulting signal then being considered as remaining constant until both signals have become valid again.

According to another feature of the invention, in the event of a failure in the control apparatus or in the power apparatus, the servo-control means for servo-controlling the axles of the bogie are neutralized by internal detection apparatus by eliminating all the power commands so that the configuration of the vehicle becomes conventional again.

A particularity of the method of the invention for centering steerable axles of a bogie lies in the fact that the servo-control means described below enable the axle to be centered relative to the track.

Given the real values of the dimensions of the radii of the curves, of the offset of the sensors in front of the axle, of the creep coefficients, and of the play of the axles across the track, when the predefined centering is satisfied to within acceptable limits, the axle becomes positioned radially relative to the track as a result of said centering.

An advantage of the method of the invention for centering steerable axles of a bogie is that it is applicable to any prior art steerable-axle bogie that is provided with at least one track detector.

Another advantage of the method of the invention for centering steerable axles of a bogie lies in the fact that each axle is pivoted about its geometrical center, whence:

the deflections of the suspension means are distributed and therefore have lower values;

the elements are symmetrical; and the motor coupling and axle link has a smaller amount of clearance.

An advantage of the steerable-axle bogie of the invention is therefore that it provides a positive guarantee to the stability function of the steerable-axle bogie.

Another advantage of the method of the invention for centering steerable axles of a bogie lies in the fact that vehicles using steerable-axle bogies of the invention can travel on tracks that do not need to be specially adapted.

BRIEF DESCRIPTION OF THE DRAWING

Other objects, features and advantages of the method of the invention for centering steerable axles of a bogie will appear on reading the following description of the servo-control principle of the invention given with reference to the accompanying drawing, in which.

MORE DETAILED DESCRIPTION

Figure 1:
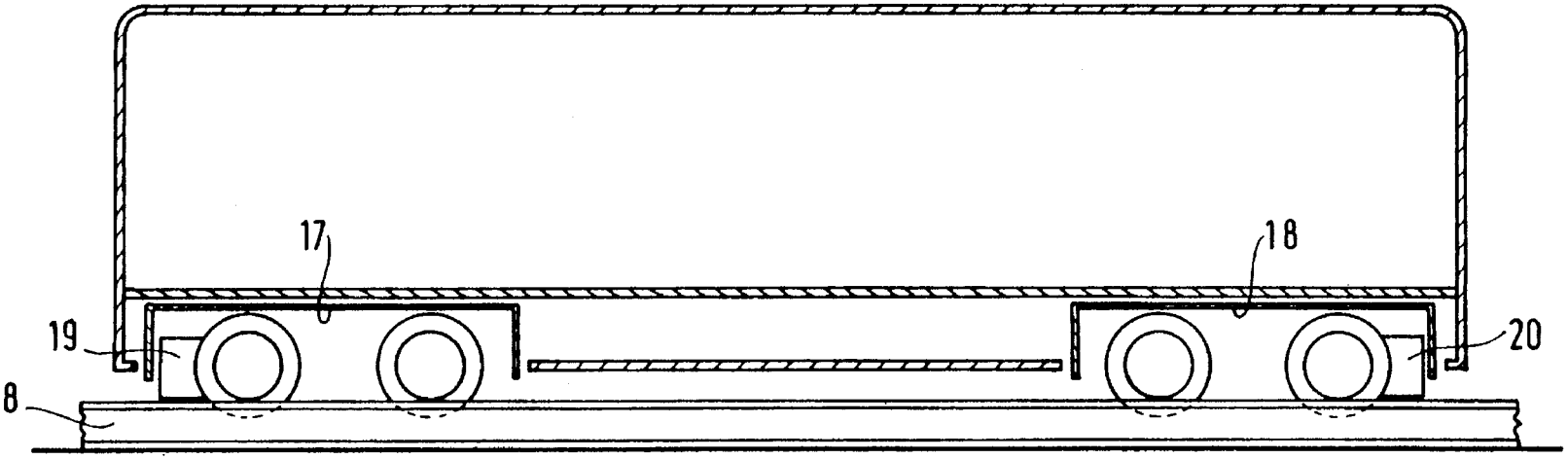
FIG. 1 is a side view of the bogies of a rail vehicle, which bogies have steerable axles that are centered by the method of the invention.
Figure 2:
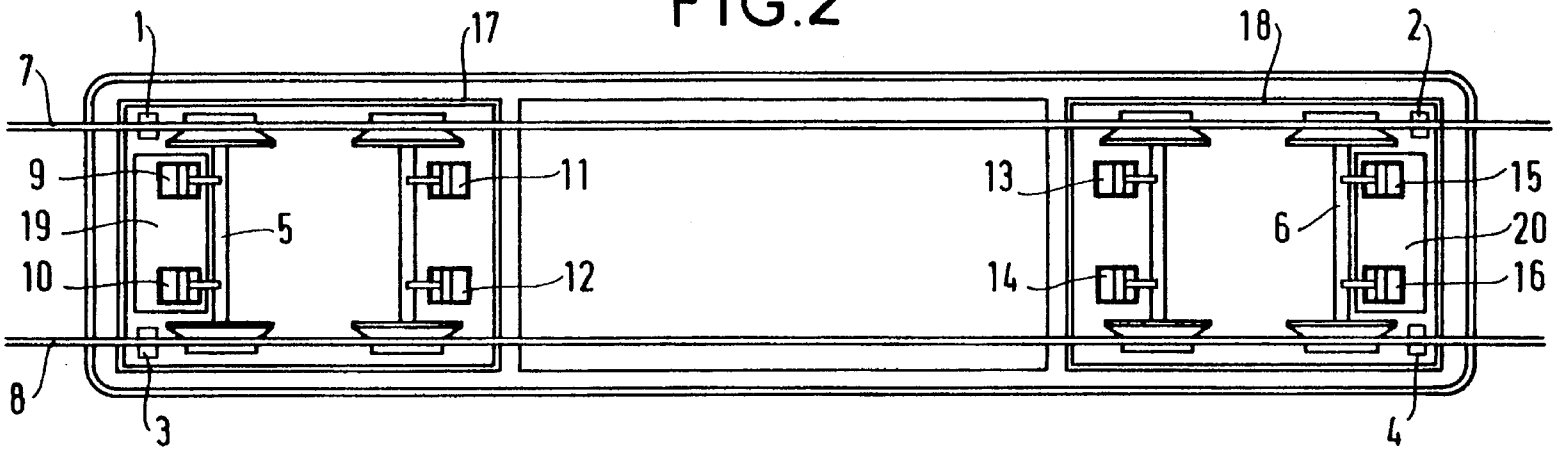
FIG. 2 is a view from below of the bogies shown in FIG. 1.

The axles of the bogie of the invention are steered by servo-control means.

In a first implementation, the servo-control means operate continuously both when the vehicle is travelling along straight stretches of the track and when it is going round curves in the track.

Sensors 1–4 are provided for the axles 5 and 6, and the function of each sensor is to detect the magnetic axis of symmetry of the rail 7 or 8 with which it is associated.

Each sensor is disposed longitudinally in front of or behind the axis of the axle. For example, the sensors are of the type described in French Patent Application No. 90.04436.

Each active sensor delivers a signal which is a function of the offset between its own position and the magnetic axis of the rail. However, these signals are not measured vertically beneath the axles, but rather they are measured in front of the axles. The signals delivered are summed to produce a resulting signal for each axle, which signal is a function of the offset of the axle relative to the longitudinal axis of the track.

The resulting signal constitutes the disturbance added to a zero reference in the external loop of position servo-control means that may include one or more other loops internally.

The output signal of the servo-control circuit controls a set of two actuators 9, 10; 11, 12; 13, 14; and 15, 16 per axle. The actuators are disposed substantially longitudinally in the bogie, and they steer the corresponding axle by bearing against the bogie frame 17, 18. The torque exerted by the actuators acts in the appropriate direction to reduce the resulting reference signal developed on the basis of the two sensors of the axle.

The object of the exercise is to keep the axles as close as possible to the center of the track, while eliminating the influence of variations in the spacing between the rails (track gauge), and while attempting to center the axles laterally at the sensors, i.e. in front of their own respective axes of rotation.

The above-described control apparatus for steering the axles is an active system. To operate, it requires at least one power source 19, 20, e.g. a hydraulic source.

In the event of a failure in the control apparatus or in the power apparatus, the servo-control means are neutralized by internal detection apparatus which eliminates all of the power commands. The vehicle is then in a conventional configuration. The servo-control means no longer operate, and the safety level of the vehicle is that of a conventional vehicle.

To this end, the steerable-axle bogie is provided with relatively stiff primary suspension means for making the vehicle sufficiently stable at its maximum commercial operating speed.

As described above, each sensor delivers a signal whose value is compared with a predefined range of values. A value that does not lie in the predefined range of values is considered to be invalid. The resulting signal is then extrapolated on the basis of a preceding value and of the only remaining valid signal. This situation occurs especially when the vehicle is passing over particular portions of track such as points and crossings. This procedure is applied until the two signals have become valid again.

In another procedure, if only one valid signal exists, then that signal is also invalidated. The last resulting signal is then considered as remaining constant until both signals have become valid again.

Naturally, other procedures are possible.

In the event that two axle sensors deliver signals that are considered to be invalid, the last resulting signal may be considered as remaining constant.

In any event, if such fault condition procedures continue over a distance that is greater than a predefined value, then a failure in the servo-control means may be assumed.

In another implementation, the steerable-axle bogie includes four sensors disposed in pairs at each end of the bogie and outside the respective axles. In other words, the steerable-axle bogie includes one pair of active sensors for each travel direction of the vehicle.

In such an implementation, the sensors enable a single resulting signal to be obtained. The single resulting signal is associated with the leading axle in the travel direction of the vehicle, and it is used to control both axles.

This implementation offers the advantage of providing very good performance levels in spite of the small number of elements.

The axles of the vehicle may be either conventional axles, with each axle having both wheels keyed to it, or else axles having independent wheels, using differentials.

Vehicles may use the safety system and procedure of the invention only for a portion of their steerable-axle bogies.

By way of example, the end axles of a vehicle may be equipped for both travel directions of the vehicle. A single resulting signal associated with the leading axle is therefore used to control four axles. To this end, and given the real values of the dimensions involved, namely: the distance between bogies, the lengths of the transition curves, and the speed, it is necessary to develop a signal which is phase-shifted relative to the initial signal for the purpose of controlling the second bogie.

We claim:

1. A method of centering steerable axles of a bogie, comprising:

detecting a first magnetic axis of symmetry of a first rail by at least one first detector to obtain a first signal which is a function of a position of the at least one first detector and a position of the first magnetic axis, detecting a second magnetic axis of symmetry of a second rail by at least one second detector to obtain a second signal which is a function of a position of the at least one second detector and a position of the second magnetic axis, summing said first and second signals so as to obtain, for one of the axle, a resulting signal which is a function of an offset between the axle and at least one of the magnetic axis, pivoting at least one axle in a direction for reducing the resulting signal, when one of the first and second signals does not lie in a predefined range of values, classifying said one of the first and second signals as being invalid, and extrapolating a resulting signal basing on a previous value of said one of the first and second signals and on the other one of the first and second signals.

2. A method according to claim 1, further comprising a step of neutralizing a servo-control means for servo-controlling the axles of the bogie when a failure occurs in at least one of a control apparatus and a power apparatus.

3. A method of centering steerable axles of a bogie, comprising:

detecting a first magnetic axis of symmetry of a first rail by at least one first detector to obtain a first signal which is a function of a position of the at least one first detector and a position of the first magnetic axis, detecting a second magnetic axis of symmetry of a second rail by at least one second detector to obtain a second signal which is a function of a position of the at least one second detector and a position of the second magnetic axis, summing said first and second signals so as to obtain, for one of the axle, a resulting signal which is a function of an offset between the axle and at least one of the magnetic axis, pivoting at least one axle in a direction for reducing the resulting signal, when at least one of the first and second signals does not lie in a predefined range of values, classifying both of the first and second signals as being invalid, and maintaining a previous resulting signal until both of the first and second signals fall within the predefined range of values.

4. A method according to claim 3, further comprising a step of neutralizing a servo-control means for servo-controlling the axles of the bogie when a failure occurs in at least one of a control apparatus and a power apparatus.

* * * * *